US006511361B2

(12) United States Patent
Koike

(10) Patent No.: US 6,511,361 B2
(45) Date of Patent: Jan. 28, 2003

(54) STUFFED TOY WHOSE WEIGHT CAN BE FREELY SET

(75) Inventor: Ataru Koike, Chiba-ken (JP)

(73) Assignee: First Page Co., Ltd., Tokyo (JP)

( * ) Notice: Subject to any disclaimer, the term of this patent is extended or adjusted under 35 U.S.C. 154(b) by 0 days.

(21) Appl. No.: 09/808,223

(22) Filed: Mar. 9, 2001

(65) Prior Publication Data

US 2001/0024926 A1 Sep. 27, 2001

(30) Foreign Application Priority Data

Mar. 21, 2000 (JP) ..... 2000-079144

(51) Int. Cl.[7] ..... A63H 3/02
(52) U.S. Cl. ..... 446/369
(58) Field of Search ..... 446/369

(56) References Cited

U.S. PATENT DOCUMENTS 1,581,382 A * 4/1926 Buchtrup ..... 446/369
3,977,121 A * 8/1976 Goldfarb et al. ..... 446/369
4,296,567 A * 10/1981 Kamar ..... 446/369
4,884,991 A * 12/1989 Terzian ..... 446/369
4,968,281 A * 11/1990 Smith et al. ..... 446/369
5,066,259 A * 11/1991 Acker ..... 446/369 X

* cited by examiner

*Primary Examiner*—John A. Ricci
(74) *Attorney, Agent, or Firm*—Greenblum & Bernstein, P.L.C.

(57) ABSTRACT

A stuffed toy that can be used as a present and whose weight can be freely set to the birth weight of the person presenting it as a gift comprises an outer material in the shape of an animal or the like and a filler material stuffed inside it, wherein the filler material of the stuffed toy, which filler is stuffed inside the outer material that is then sewn together, comprises a heavy material made from stones, steel balls or the like and a light material made from cloth, synthetic resin or the like, and the overall weight of the stuffed toy is freely set to a selected weight between 0.9 kg and 4.5 kg, which is the birth weight of the person giving the gift, by adjusting the relative weights of the filler materials.

8 Claims, 2 Drawing Sheets

STUFFED TOY WHOSE WEIGHT CAN BE FREELY SET

BACKGROUND OF THE INVENTION

1. Field of the Invention

This invention relates to a stuffed toy filled with cotton or the like in its abdominal area, and more particularly it relates to a stuffed toy for use as a present in which the weight can be freely set to one's birth weight.

2. Prior Art Statement

Everyone loves stuffed toys, and they are a product liked by men and women regardless of age; i.e., adults as well as children. Character products, in particular, are generally popular regardless of age or sex, and except that they are a little expensive, they are considered ideal presents.

In addition to using this stuffed toy as a regular birthday present, it can also be used as a present at a wedding. A stuffed toy can be given to parents instead of a bunch of flowers or together with flowers, but since there is no added value in just giving a stuffed toy, some kind of contrivance must be considered, and making the weight of a favorite teddy bear or other stuffed toy the birth weight of the person having the wedding can be considered.

However, prior art stuffed toys do not have the weight of a baby, and their weight is generally fixed since they use a relatively light material. Also, toy dolls and stuffed toys do not have a structure that allows their weight to be changed. Particularly, since it was not expected that there would be a demand to increase the weight of a doll, the structure of stuffed toy dolls has not changed, and they do not have a structure wherein they can be sewn together after selecting the weight of the material used as a weight to determine the overall weight.

If the weight is to be changed in accordance with the needs of customers, then each product would have to be manufactured individually with a different weight and could not be mass produced, thus reducing production efficiency. The technology allows the weight to be changed, but the time, procurement of materials and sewing operation become difficult, thus making it impossible to answer this need.

Even though there is a large demand at weddings for this type of product and the need does exist, there is no system for easily receiving orders and producing dolls with a prescribed weight. However, since there time until the product is delivered, it is possible to produce this kind of product, and if a doll with a new kind of structure is invented, it is possible to build a production system that mechanically receives orders for weight, fabricates the doll by the date of the wedding and delivers it.

This invention eliminates the problem with prior art stuffed toys by facilitating the production of stuffed toys with a specific weight for use as a present, and its purpose is to offer a stuffed toy that allows the weight to be set freely by providing a pouch in the abdominal area of the stuffed toy and filling it with a weight-adjusted material comprising a heavy material and a light material.

SUMMARY OF THE INVENTION

In order to achieve the above purpose, the stuffed toy whose weight can be freely set of this invention comprises a cloth or other soft outer material in the shape of an animal or the like, and a filler stuffed inside said outer material and is made by sewing together the ends of the outer material after stuffing the filler inside the pouch-shaped outer material, wherein the filler comprises stones, steel balls or other heavy material and a light material made from cloth or synthetic resin and the weight of the stuffed toy can be freely selected.

Also, the overall weight of the stuffed toy can be set to the birth weight of a particular person or the person giving the gift.

In another aspect of the invention, the stuffed toy comprises a cloth or other soft outer material in the shape of an animal or the like and a filler stuffed inside said outer material and is made by sewing together the ends of the outer material after stuffing the filler inside the pouch-shaped outer material, wherein the outer material has a storage place inside it where the filler is housed and the weight of the stuffed toy can be adjusted by adjusting the relative weights of the heavy material and the light material filled inside said storage place, whereby stuffed toys with the same volume but different weights are produced.

In another aspect of the invention, the filler material comprises stones, steel balls or other heavy material and a light material made from cloth or synthetic resin, and the overall weight of the stuffed toy can be set to that of a bride and/or groom when they were born and given by them to the parents of the bride and/or groom at their wedding.

Since the set weight is the weight of a person when they were born, the filler material comprises stones, steel balls or other heavy material and a light material made from cloth or synthetic resin, and the weight of the stuffed toy can be freely set between 0.9 kg and 4.5 kg.

DESCRIPTION OF THE PREFERRED EMBODIMENTS

Figure 1:
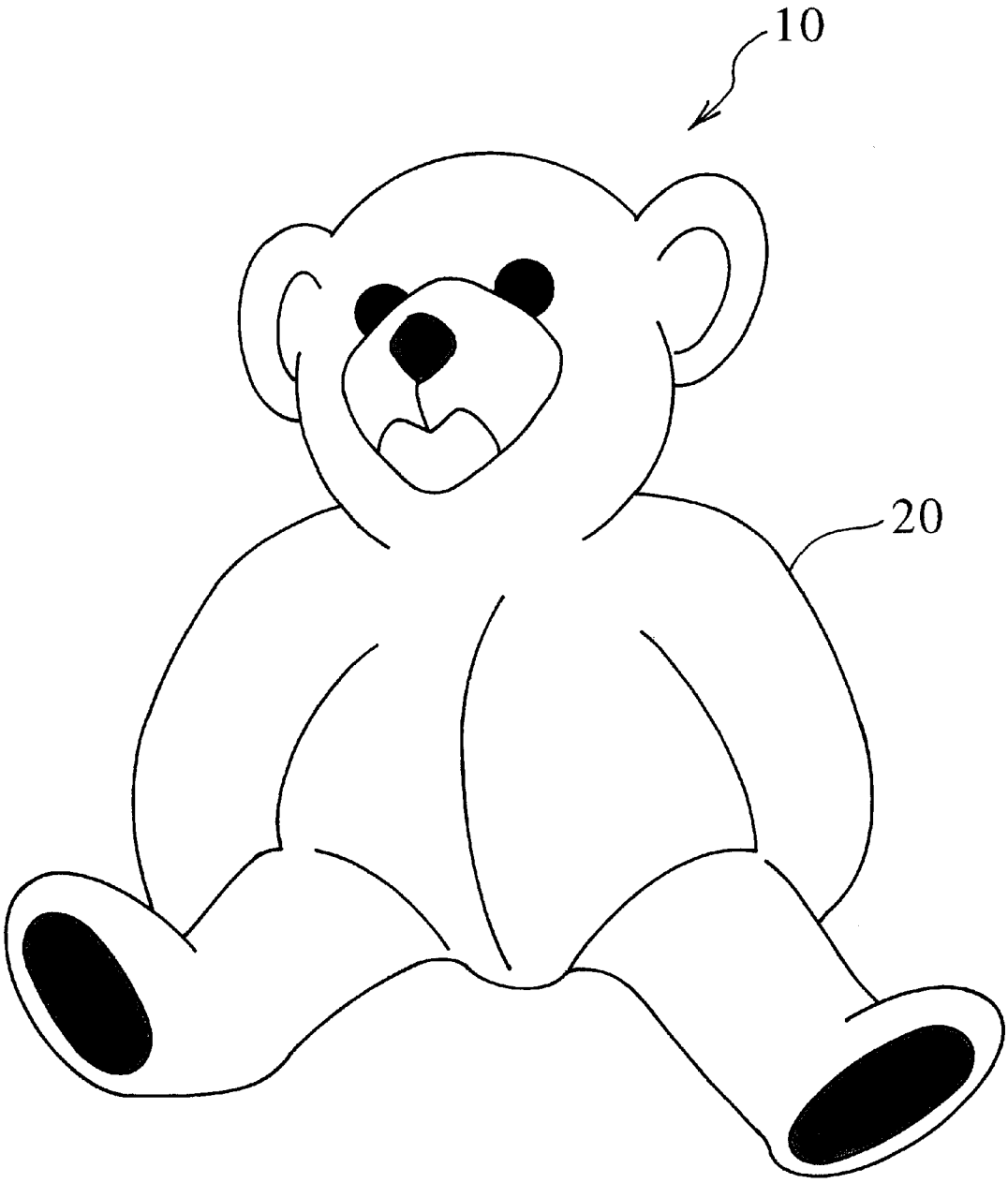
FIG. 1 is a perspective view of the stuffed toy whose weight can be freely set of this invention.
Figure 2:
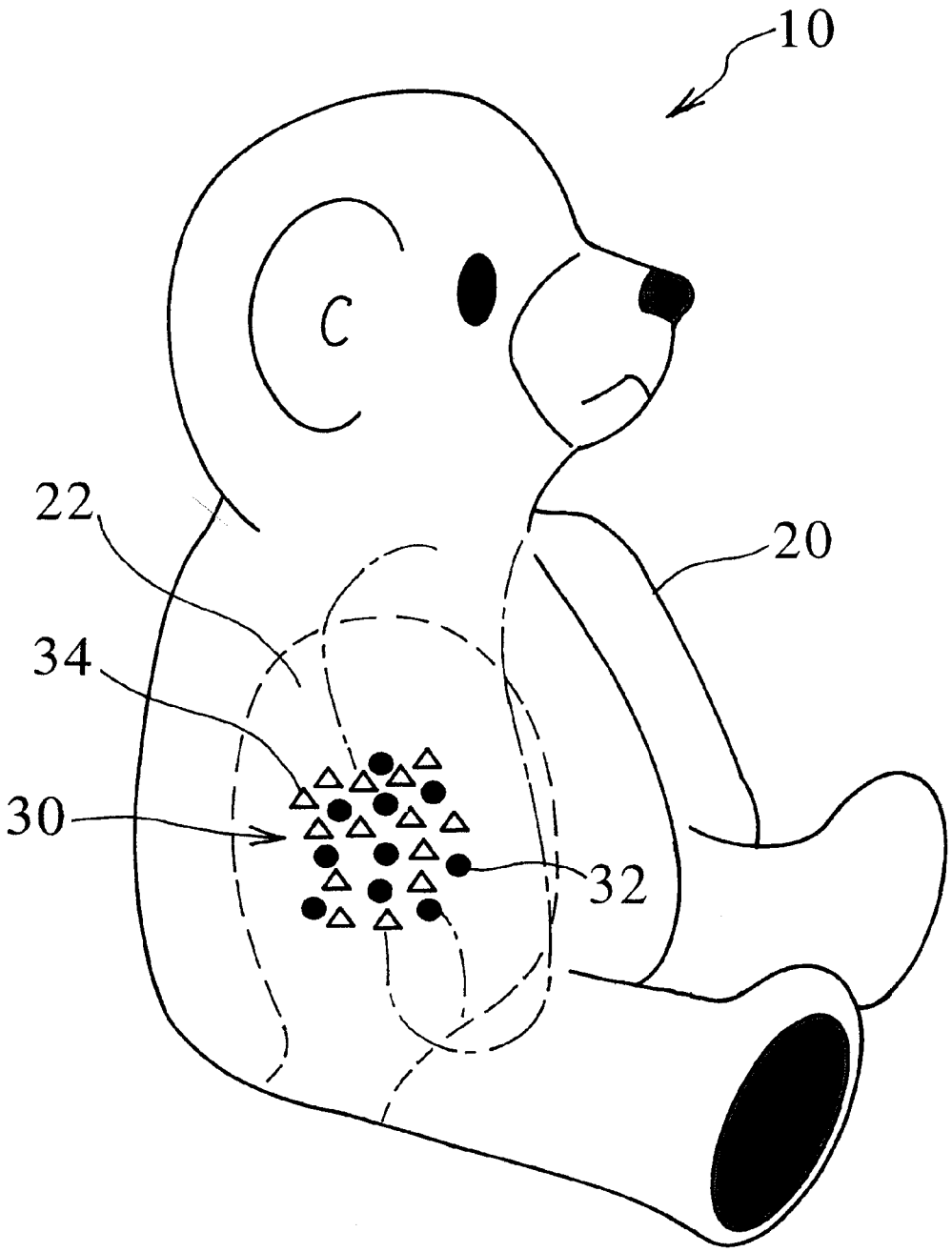
FIG. 2 is a partial cut away view of the stuffed toy whose weight can be freely set of this invention.

The stuffed toy whose weight can be freely set of this invention is described in detail below through embodiments shown in the drawings. FIG. 1 is a perspective view showing the stuffed toy whose weight can be freely set of this invention, and FIG. 2 is a cross section of FIG. 1. The stuffed toy 10 whose weight can be freely set of this invention comprises an outer material 20 and filer 30. The stuffed toy is made with the outer shape of a doll or an animal by filling the inside of an outer material in the shape of an animal or the like with a filler and then sewing the ends of the outer material together.

The outer material 20 has the outer shape of an animal, character doll or other popular stuffed toy and is formed into a pouch into which the filler is stuffed. The type of animal or character forming the outer shape is not restricted. Further, the normal outer material is made from a cloth or other soft material and its outer surface is formed into the outer shape of a character. Also, in the case of an animal stuffed toy, false hair or skin similar to the real animal may be applied to said outer surface. Filler is stuffed inside the outer material, but in addition to regular filler, a pouch 22 for holding the filler 30 described below is disposed inside the outer material 20 of this invention.

The filler 30 comprises stones, steel balls or other heavy material 32 with a high specific gravity and a light material 34 made from cloth or synthetic resin such as granular plastic and is used in place of the cloth, cotton (waste cloth) and other fillers used in the prior art. The shape of the heavy material and the light material is not restricted to a ball shape, but rather they can have various granular or pellet shapes. Further, as long as it presents no danger, a non-uniform material in which powder is mixed can be used in the filler housing. It is also desirable that a material that changes little over time be used, and it is even more desirable that a material that has been treated to prevent oxidation be used.

A heavy material or light material that can be supplied in large quantities with a consistent quality can be used, and this embodiment uses stones or steel balls, for which a stable supply is available on the market and which can be readily acquired, as the heavy material and a granulated plastic material, which can also be readily acquired, as the light material.

In order to achieve the set weight selected for the stuffed toy in this invention, said pouch 22 is filled with adjusted amounts of a heavy material and a light material separate from the regular filler material. Further, in this invention, it is possible to adjust the weight of the stuffed toy to the birth weight of the person giving it as a gift.

The application of the stuffed toy is not restricted, but in this invention, when used as a gift, particularly when given as a gift to the parents of the bride and/or groom at the end of a wedding ceremony, the weight of the stuffed toy can be set to the birth weight of the bride and/or groom, who are giving the gift, as described above. By this means, the parents can reflect that the weight of their children when they held them at the time of their birth was the weight of the stuffed toy and that that infant has grown into an adult and is now getting married.

The way in which a stuffed toy whose weight can be freely set is used is not limited to that described above; for example, if a grandchild is born, the grandfather or grandmother may give it as a present to the son or daughter who is the parent of the new baby. Also a gynecological department may want to present a stuffed toy as a gift to each new mother (or visitor) which weighs the same as when their baby was born. When giving a child a stuffed toy, a stuffed toy weighing the same as the child when they were born could be used. In this embodiment, a teddy bear is used at the stuffed toy.

Weights at the time of birth are between about 2 kg and 4 kg, and there is fun in finding out one's own actual weight and conveying that information to the manufacturer. In this embodiment of the invention, the stuffed toy is shaped in the form of a teddy bear and the weight of the stuffed toy ranges from 0.9 kg to 4.5 kg. When giving as a gift at a wedding, there is enough time to order stuffed toys with the correct weights in advance and to have each one made with those respective weights, but when giving to a grandchild or buying for a child, ordering and making the stuffed toy takes time, which presents a problem.

To address this problem, products are produced in advance with different weights in 500 g units, and then the overall weight of the stuffed toy can be fine adjusted by adding a bell or other heavy decoration or by using a relatively heavy material on the back of the arms and legs. It is also possible to adopt a configuration wherein products with different weights are produced in 200 g units and whose weights are fine adjusted with decorations.

In addition to decorations, a method could be considered wherein products with fixed weights are produced in advanced and silicon or other heavy liquid that hardens is injected into the abdominal area based on the order. Extremely light products could also be made available in anticipation of underweight infants.

Further, a method could be considered wherein the Internet is used to receive detailed orders with weight at the time of birth, the type of stuffed toy, etc., and each toy is ordered from the manufacturer individually. As for shipping, the manufacturer could be instructed to deliver to a wedding or other prescribed delivery location.

By means of the stuffed toy whose weight can be freely set of this invention described above:

1. it is easy to set the weight of the stuffed toy, which could not be done in the prior art, by adjusting the weight of stones or steel balls and cloth or synthetic resin used as filler,
2. the weight of the stuffed toy can be set to the birth weight of the person giving the gift by adjusting the weight of the stones or steel balls and cloth or synthetic resin used as filler,
3. stuffed toys having the same size and/or shape but different weights can be easily provided by adjusting the weight of the heavy material and light material,
4. a stuffed toy made with the birth weight of the person giving it as a gift by adjusting the weight of the heavy material filled in a pouch based on an order received in advanced can be given by a bride and/or groom to their parents on the day of their wedding, and
5. by setting the weight of the stuffed toy to between 0.9 kg and 4.5 kg and assuming the birth weight is within this range, a one-of-a-kind stuffed toy with the exact same weight can be easily acquired any time at relatively low cost.

What is claimed is:

1. A stuffed toy having a weight that can be freely set, comprising:

an outer material in the shape of a nonhuman animal;

a filler comprising a first material and a second material, said second material being heavier than said first material, said second material comprising a heavy material and a light material, said heavy material being heavier than said light material; and a pouch inside said outer material and configured to accept said second material;

wherein:

said shape of said outer material is configured to be filled by said first material between said pouch and at least part of said outer material;

said outer material is configured to be closed after said outer material is filled with said first material, and said pouch is configured to be closed after said pouch is filled with said second material; and an amount of at least one of said first material and said second material is configured to be freely set, to establish a weight of the stuffed toy, said established weight corresponding to a weight of a predetermined human infant.

2. The stuffed toy according to claim 1, wherein said weight of the predetermined infant corresponds to a weight of an individual presenting the stuffed toy, at the time the individual was an infant.

3. The stuffed toy according to claim 2, wherein the individual is one of a bride and groom, and a second individual to whom the stuffed toy is presented is a parent of said one of a bride and groom.

4. The stuffed toy according to claim 1, wherein said light material comprises at least one of cloth and synthetic resin, and said heavy material comprises at least one of stones and steel balls.

5. The stuffed toy according to claim 1, wherein the proportion between said light material and said heavy material within said pouch is variable such that a predetermined weight of the stuffed toy is configured to be varied, while a volume occupied by said second material within said pouch is substantially constant.

6. The stuffed toy according to claim 1, wherein said second material comprises at least one of stones and steel balls.

7. The stuffed toy according to claim 1, wherein the weight of the stuffed toy is configured to be freely set between approximately 0.9 kg and approximately 4.5 kg.

8. A stuffed toy having a weight that can be freely set, comprising:

an outer material in the shape of a nonhuman animal;

a filler comprising a first material and a second material, said second material being heavier than said first material, said second material comprising a heavy material and a light material, said heavy material being heavier than said light material;

a pouch inside said outer material and configured to accept said second material;

wherein:

said shape of said outer material is configured to be filled by said first material between said pouch and at least part of said outer material; and said outer material is configured to be closed after said outer material is filled with said first material, and said pouch is configured to be closed after said pouch is filled with said second material.

* * * * *